US007163413B2

(12) United States Patent
Murayama

(10) Patent No.: US 7,163,413 B2
(45) Date of Patent: Jan. 16, 2007

(54) CABLE CONNECTOR HAVING A PULL TAB LOCK RELEASE

(75) Inventor: Ryusuke Murayama, Tokyo (JP)

(73) Assignee: Tyco Electronics AMP K.K, Kanagawa-Ken (JP)

( * ) Notice: Subject to any disclaimer, the term of this patent is extended or adjusted under 35 U.S.C. 154(b) by 0 days.

(21) Appl. No.: 11/352,783

(22) Filed: Feb. 13, 2006

(65) Prior Publication Data

US 2006/0189198 A1 Aug. 24, 2006

(30) Foreign Application Priority Data

Feb. 21, 2005 (JP) ..... 2005-044213

(51) Int. Cl.
*H01R 13/62* (2006.01)

(52) U.S. Cl. ..... 439/258; 439/352

(58) Field of Classification Search ..... 439/258, 439/352, 357, 483, 484, 152, 160, 923
See application file for complete search history.

(56) References Cited

U.S. PATENT DOCUMENTS 5,380,216 A 1/1995 Broeksteeg et al.
6,447,170 B1 9/2002 Takahashi et al.
2005/0233631 A1* 10/2005 Wu ..... 439/352

FOREIGN PATENT DOCUMENTS

JP 63-56563 4/1988
JP 2003-297482 10/2003

* cited by examiner

*Primary Examiner*—Tho D. Ta
(74) *Attorney, Agent, or Firm*—Barley Snyder LLC

(57) ABSTRACT

A cable connector which enables high-density mounting while reducing the risk of the locking arm being damaged or deformed is disclosed. The cable connector (1) comprises housings (10 and 30) that support a cable (C) and that have a locking arm (14) to be locked with a mating connector (50). A pull-tab (40) is connected to the locking arm (14). The pull-tab (40) is inserted into holes (18 and 19) that are respectively formed in the upper section (12) of the housings (10 and 30) and in the upper section (17) of the locking arm (14). When the pull-tab (40) is pulled in direction approximately opposite from the mating direction (i.e., in the direction of arrow A), the pull-tab (40) causes an approaching motion between the upper section (12) of the housings (10) and (30) and the section (17) of the locking arm (14), thus releasing the locking arm (14) from the mating connector (50).

8 Claims, 7 Drawing Sheets

PRIOR ART

CABLE CONNECTOR HAVING A PULL TAB LOCK RELEASE

FIELD OF THE INVENTION

The present invention relates to an electrical connector and more particularly to a cable connector having a pull-tab.

BACKGROUND

An example of a known cable connector having a pull-tab is shown in FIG. 6 (see JP63-56563U). The cable connector 101 shown in FIG. 6 comprises a substantially rectangular insulating housing 110 that supports a cable 113. Furthermore, a pull-tab attachment hole 111 that extends in the direction of width of the housing 110 is formed at the end portion of the housing 110, and a pull-tab 112 is attached via the pull-tab attachment hole 111. This cable connector 101 is designed so that following mating with a mating connector (not shown in the figure), it may be released by pulling the pull-tab 112.

However, this cable connector 101 does not have a mechanism for actively locking with the mating connector, and the pull-tab 112 is not designed to perform the function of releasing the locking mechanism with the mating connector.

Meanwhile, the connector shown in FIGS. 7A and 7B (see JP2003-297482A), for instance, has a pull-tab connected to a locking mechanism with a mating connector, with this pull-tab performing the function of releasing the locking mechanism. FIG. 7A is a plan view showing the schematic construction of the connector, and FIG. 7B is a plan view showing the construction of the connector.

This connector 201 shown in FIGS. 7A and 7B comprises a substantially rectangular insulating housing 210 and a plurality of contacts 211 that are attached to the housing 210 along the width of this housing 210. Furthermore, a pair of locking arms 212 that are attached so that these locking arms 212 can pivot about respective pivoting central shafts 214 are provided at either end of the housing 210. Engaging claws 213 that are locked with engagement parts provided on the left and right side surfaces of a mating connector (not shown in the figures) are provided so that these engaging claws 213 protrude inward from the front ends (upper ends in FIG. 7A) of the respective locking arms 212. Meanwhile, both ends of a pull-tab 215 are respectively joined to the rear ends of the pair of locking arms 212. The pull-tab 215 is integrally formed with the pair of locking arms 212.

Furthermore, when the connector 201 is mated with the mating connector, the engaging claws 213 of the respective locking arms 212 are locked with the engagement parts of the mating connector. This locking action is performed by the locking arms 212 first pivoting about the pivoting central shafts 214 in the directions indicated by arrows (3), i.e., in an outward direction, and then pivoting in the opposite directions (i.e., in an inward direction), and the locked state is maintained by the elasticity of the pull-tab 215. Accordingly, there is no accidental release of the locked state of the connector 201 with the mating connector.

Then, the connector 201 can be disengaged from the mating connector by pulling the central portion of the pull-tab 215 with the fingers in the direction of arrow (1), i.e., in the rearward direction. The force generated when the pull-tab is pulled in the direction of arrow (1) is divided between the directions indicated by arrows (2), i.e., in an inward direction, and the direction indicated by arrow (4), i.e., in the rearward direction. A moment acts on the respective locking arms 212 in the directions indicated by arrows (3) by means of the force in the directions indicated by arrows (2). As a result, these locking arms 212 respectively pivot in the directions indicated by arrows (3) about the respective pivoting central shafts 214, so that the locked state with the mating connector is released. Then, the connector 201 can be completely disengaged from the mating connector by the force in the direction of arrow (4).

However, the following problems have been encountered in the connector 201 shown in FIGS. 7A and 7B. Specifically, since the pair of locking arms 212 are required at either end of the housing 210 in the direction of width, the mounting space is correspondingly increased, so that there is a problem in that the mounting density of the connector is reduced.

Furthermore, there are cases in which the locking arms 212 are damaged or deformed as a result of the force in the direction of arrow (4) being applied during release of engaging claws 213 of the locking arms 212 from the engagement parts of the mating connector. Moreover, the operation of the pull-tab 215 is also less than optimal because of the application of the force in the direction of arrow (4) to the locking arms 212.

SUMMARY OF THE INVENTION

Accordingly, the present invention was devised in light of the problems described above. It is an object of the present invention, among others, to provide a cable connector which enables high-density mounting while reducing the risk of the locking arms being damaged or deformed.

A cable connector according to an embodiment of the invention has a housing that supports a cable and that has a locking arm to be locked with a mating connector. A pull-tab that is connected to the locking arm, wherein the pull-tab is inserted into holes that are respectively formed in the end part of the housing and the end part of the locking arm. When the pull-tab is pulled in a direction approximately opposite the mating direction, the pull-tab causes an approaching motion between the upper section of the housing and the upper section of the locking arm, thus releasing the locking arm from the mating connector.

BRIEF DESCRIPTION OF THE DRAWINGS

The invention will now be described by way of example with reference to the following drawings of which.

DETAILED DESCRIPTION OF THE EMBODIMENT(S)

Figure 1:
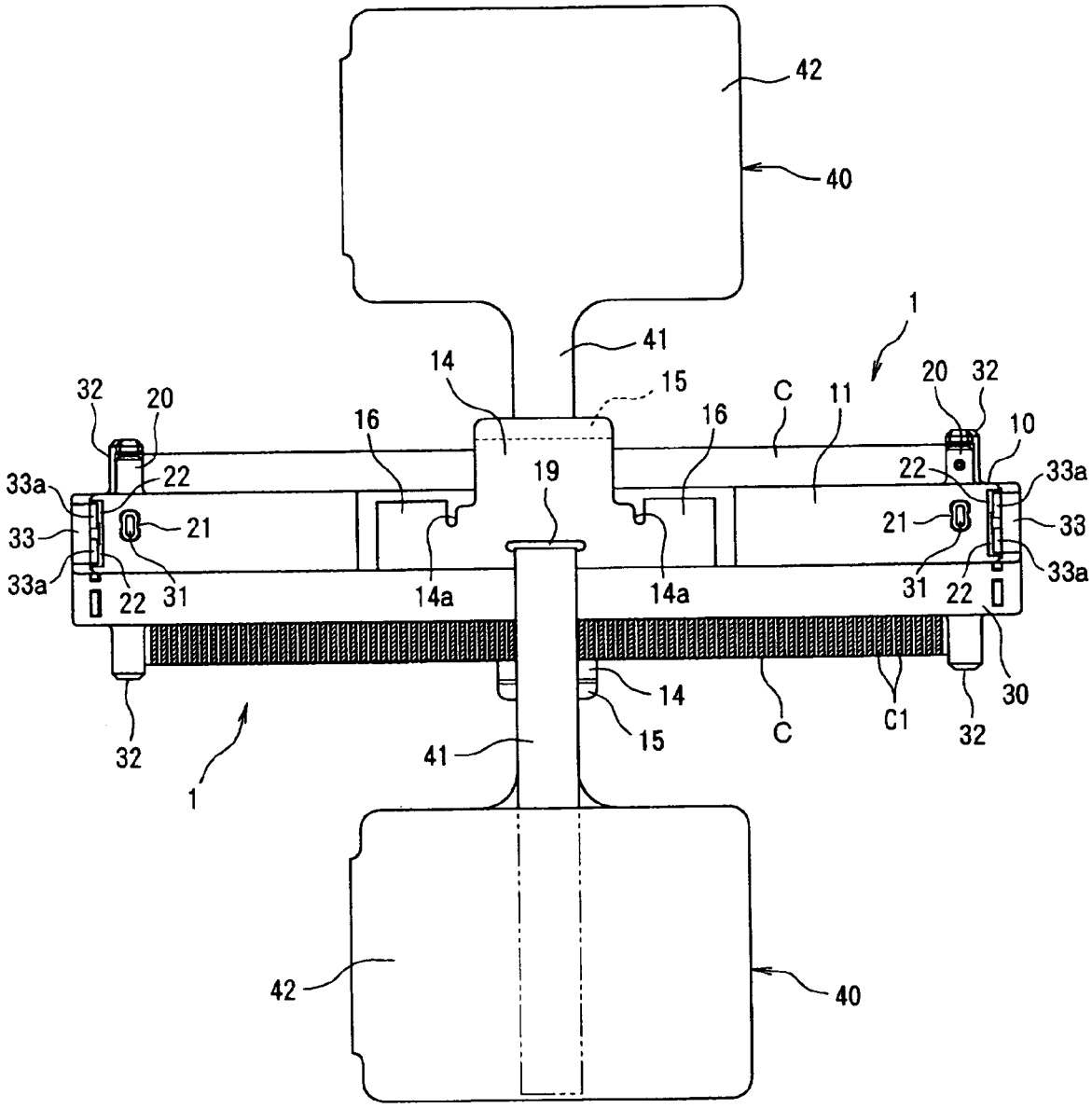
FIG. 1 is a front view of an assembly in which the cable connectors of the present invention are disposed on both ends of a cable.
Figure 2:
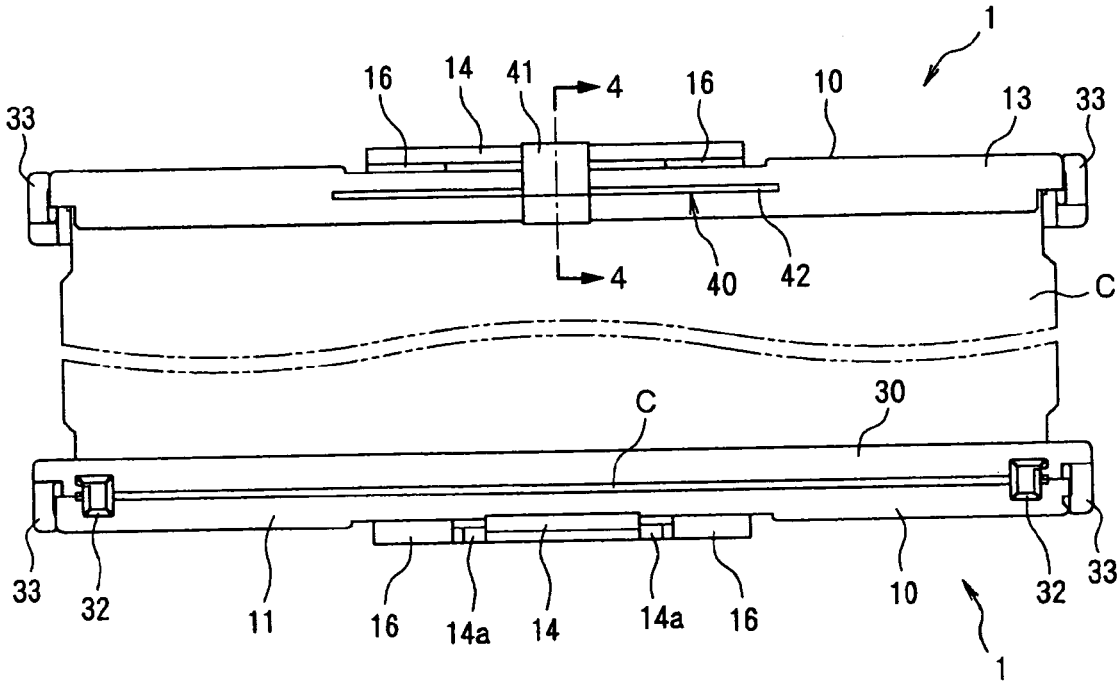
FIG. 2 is a plan view of the assembly shown in FIG. 1.
Figure 3:
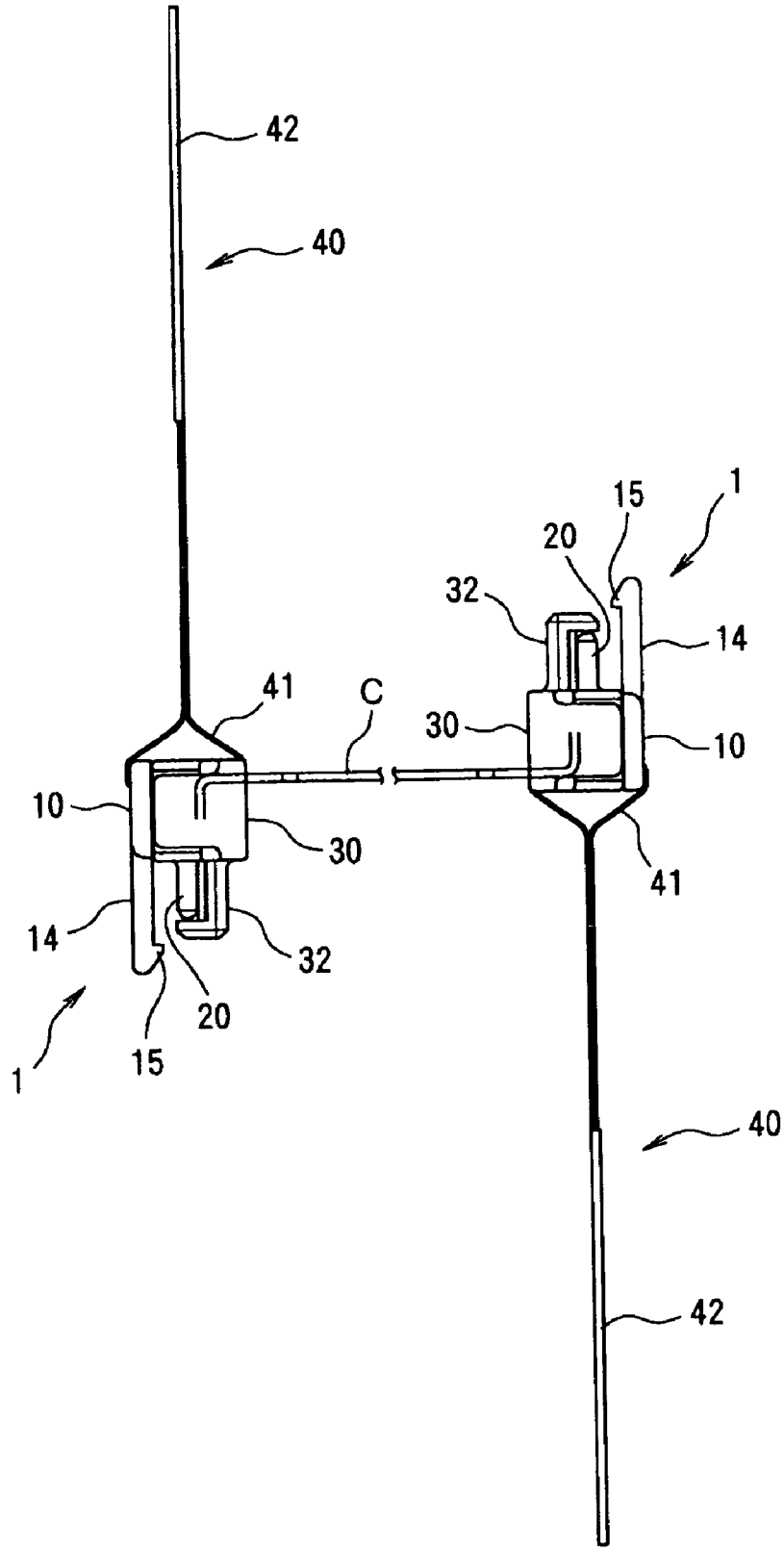
FIG. 3 is a left-side view of the assembly shown in FIG. 1.
Figure 4:
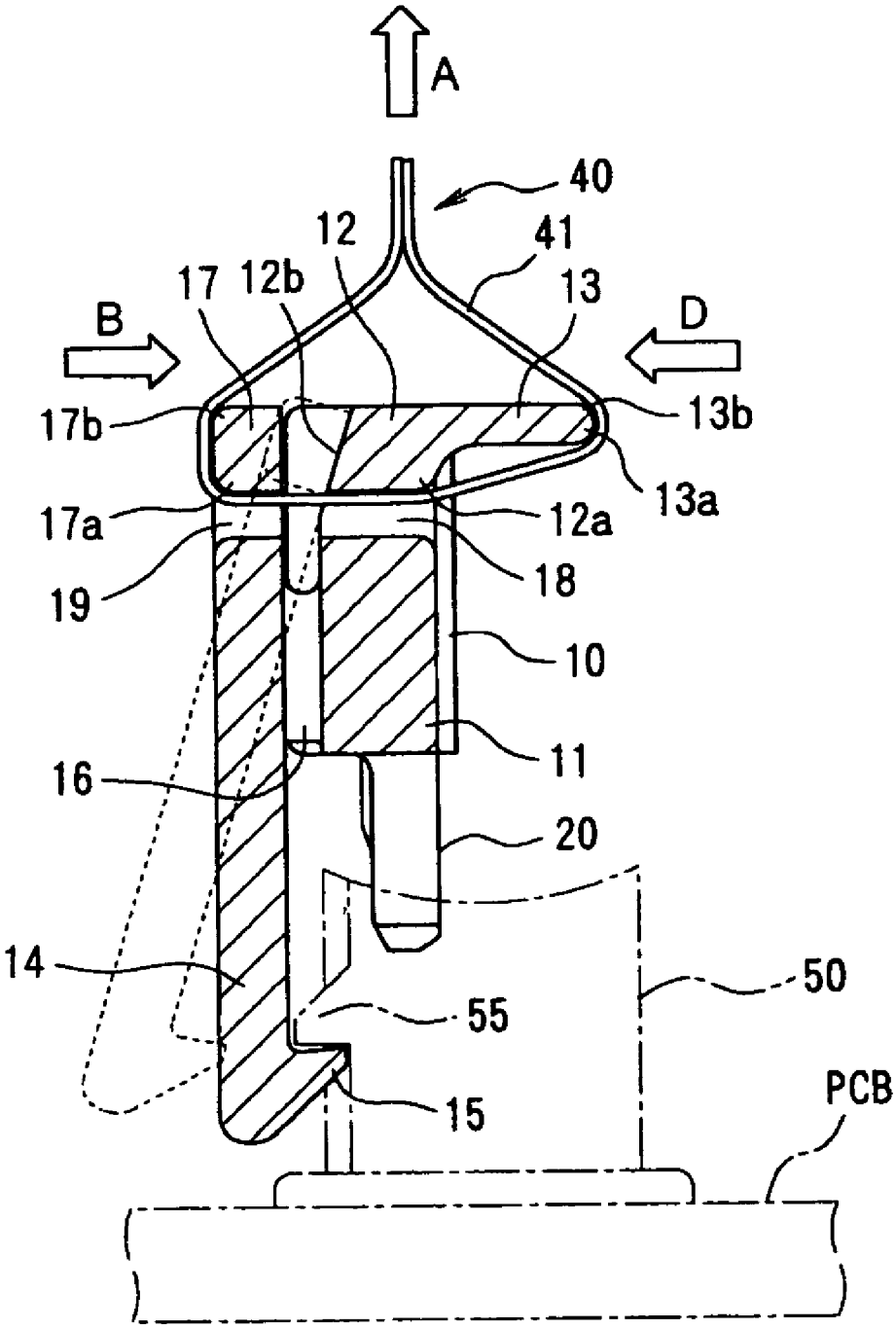
FIG. 4 is a sectional view along line 4—4 in FIG. 2 shown with a mating connector and a circuit board indicated by broken lines.
Figure 5A:
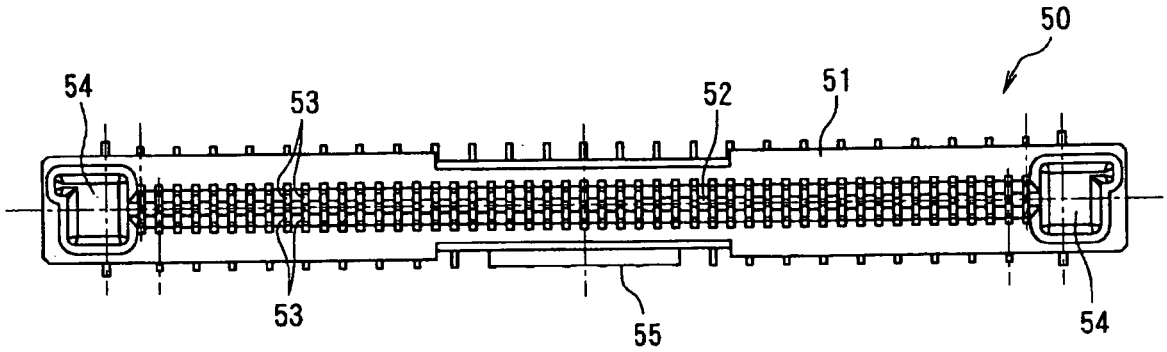
FIGS. 5A to 5C show a mating connector with which the cable connector shown in FIG. 1 mates, with FIG. 5A being a plan view, FIG. 5B being a front view, and FIG. 5C being a left-side view.
Figure 5B:
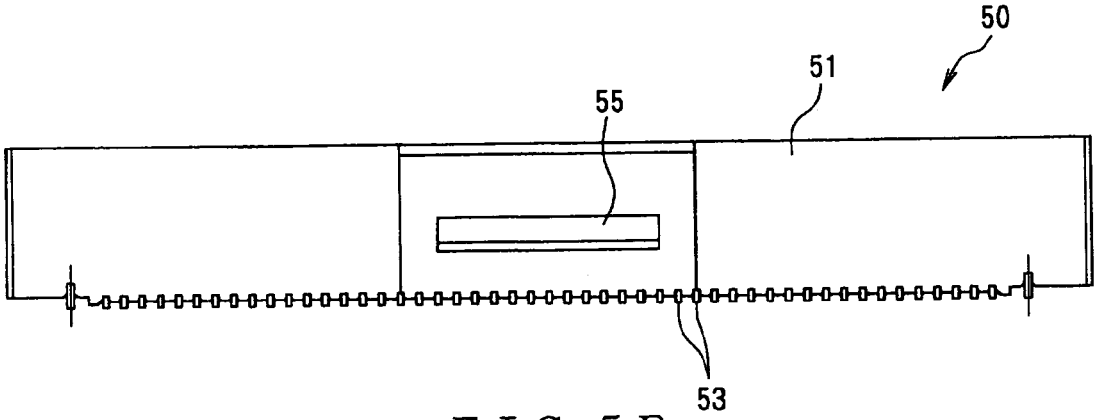
Figure 5C:
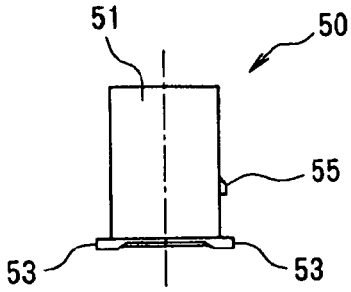
Figure 6:
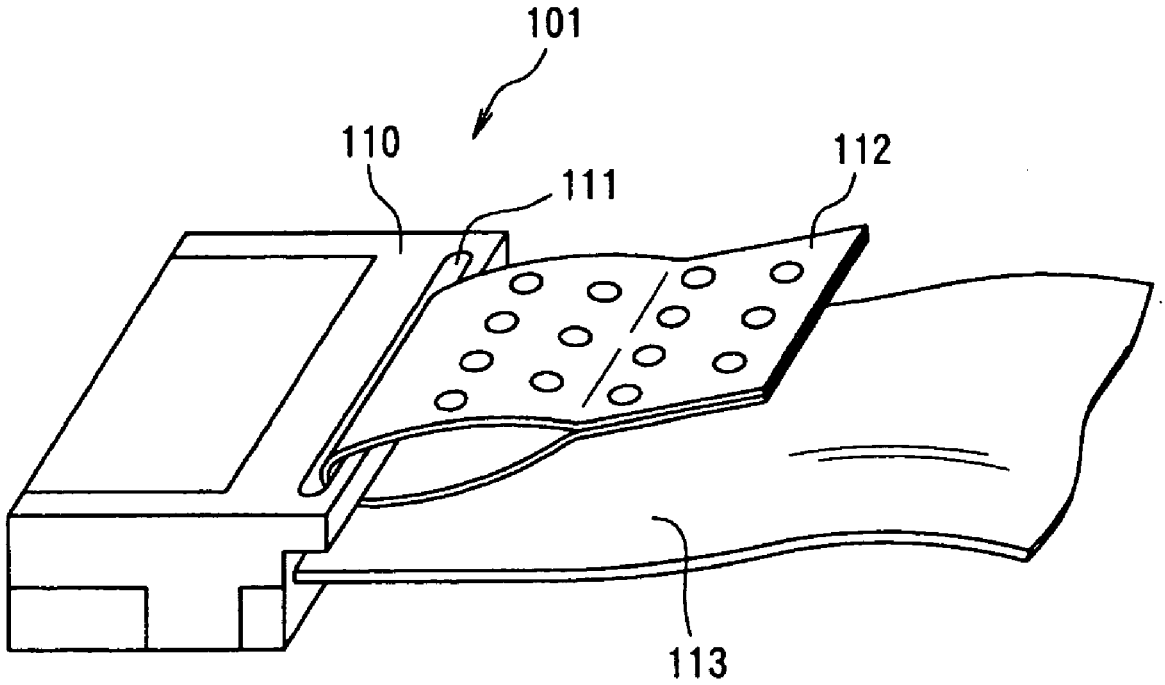
FIG. 6 is a perspective view showing one example of a conventional cable connector having a pull-tab.
Figure 7A:
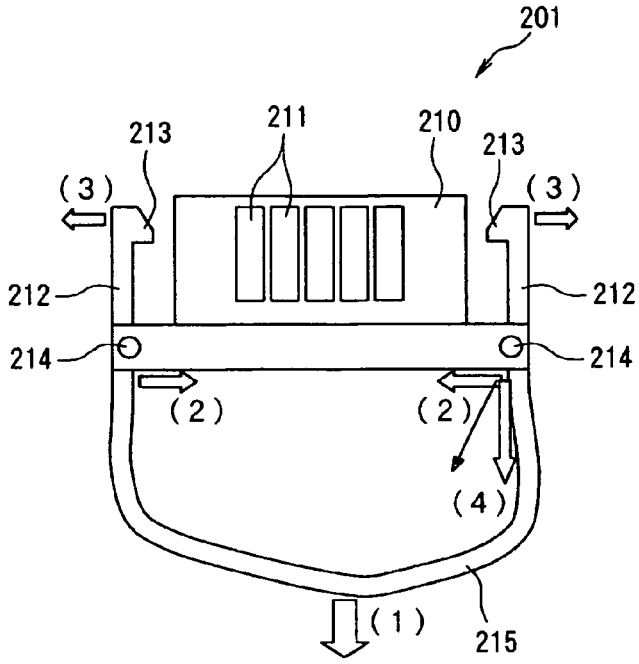
FIG. 7A PRIOR ART
FIGS. 7A and 7B show one example of a conventional connector in which a pull-tab performs the function of releasing the locking mechanism, with FIG. 7A being a plan view showing the schematic construction of the connector, and FIG. 7B being a plan view of the connector.
Figure 7B:
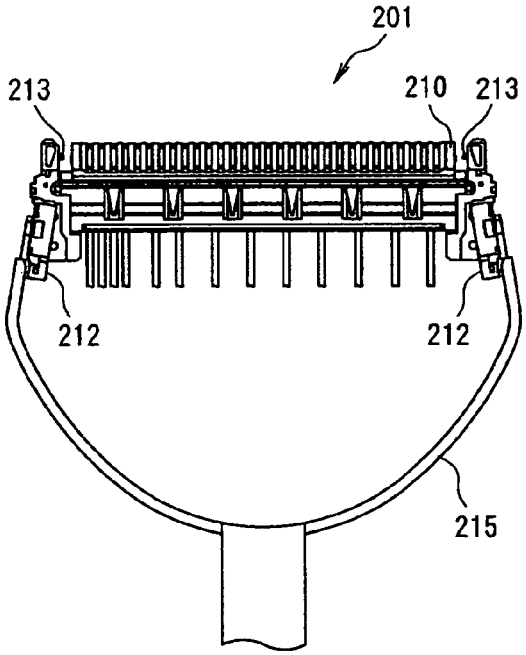
FIG. 7B PRIOR ART

An embodiment of the present invention will now be described in greater detail with reference to the figures. In FIGS. 1 through 3, a pair of cable connectors 1 is arranged on either end of a cable C such as a flexible flat cable (FFC) such that the tops and bottoms of these cable connectors are inverted relative to each other. As is shown in FIG. 4, each cable connector 1 is designed to mate with a mating connector 50 that is mounted on a circuit board PCB. Since the pair of cable connectors 1 have the same construction and shape, and act in the same manner, the construction and operation of the cable connector 1 that is disposed on one end of the cable C (on the left side in FIG. 3) will be described below.

Here, the cable connector 1 comprises a first housing 10, a second housing 30, and a pull-tab 40. The first housing 10 and the second housing 30 constitute the "housing" as described herein. The first housing 10 is formed by molding an insulating material, and has a substantially rectangular housing main body 11. As is clearly shown in FIG. 4, at the upper section 12 of the housing main body 11, a wall 13 is formed which extends from the upper section 12 in the cable lead-out direction which is approximately perpendicular to the mating direction. Furthermore, a locking arm 14 that is locked with the mating connector 50 is provided in the central portion of the housing main body 11. The locking arm 14 is linked with the end surface of the housing main body 11 by a pair of linking parts 16 that are present on either side of the locking arm 14. As is indicated with the broken line in FIG. 4, the locking arm 14 can swing in a direction approximately perpendicular to the mating direction by means of elastic deformation of the area around the linking parts 16 being used as the pivot. A locking projection 15 that is locked with a locking projection 55 of the mating connector 50 is provided at the bottom end of the locking arm 14. Furthermore, as is shown in FIG. 1, a pair of notches 14*a* for allowing the locking arm 14 to swing easily by means of elastic deformation is formed on either side of the locking arm 14. An angled surface 12*b* is formed on the end surface of the upper section 12 of the housing main body 11 on the opposite side from the cable lead-out direction to provide a clearance when the locking arm 14 swings as indicated with the broken line in FIG. 4. In addition, a first hole 18 and a second hole 19 through both of which the belt portion 41 of the pull-tab 40 is inserted are respectively formed in the upper section 12 of the housing main body 11 and in the upper section 17 of the locking arm 14. The first hole 18 provided in the housing main body 11 is formed in the upper section 12 of the housing main body 11 so that the first hole 18 passes through in a direction perpendicular to the mating direction, and the second hole 19 provided in the locking arm 14 is formed in the upper section 17 of the locking arm 14 so that it also passes through in a direction perpendicular to the mating direction. The corner edge 12*a* in the cable lead-out direction of the first hole 18 provided in the housing main body 11, the corner edges 13*a* and 13*b* of the wall 13 in the cable lead-out direction, the corner edge 17*a* of the second hole 19 provided in the locking arm 14 on the opposite side from the cable lead-out direction, and the corner edge 17*b* of the upper section 17 of the locking arm 14 are formed as rounded surfaces. These rounded surfaces are designed to be contacted by the belt portion 41 of the pull-tab 40 during the pull operation of the pull-tab 40. Furthermore, as is shown in FIG. 1, a pair of engagement holes 21 which pass through in a direction perpendicular to the direction of mating with the mating connector 50 are formed in the vicinity of either end of the housing main body 11. Moreover, a plurality of pairs of locking projections 22 that protrude outward are provided on either end of the housing main body 11 in the direction of length. In addition, a pair of cable supporting projections 20 that support either end of the cable C in cooperation with cable supporting parts 32 of the second housing 30 are formed so as to protrude from the undersurface of the housing main body 11 at either end.

Furthermore, the second housing 30 is formed in a substantially rectangular shape that extends in the direction of length (left-right direction in FIGS. 1 and 2) by molding an insulating material. A pair of engaging projections 31 that are inserted through through-holes (not shown in the figures) formed in one end portion of the cable C in the direction of length and that engage with the engagement holes 21 in the first housing 10 as shown in FIG. 1 are formed so that these engaging projections 31 protrude from the vicinity of either end of the second housing 30. Moreover, a pair of locking arms 33 that extend so as to face the outer surfaces at both ends of the housing main body 11 are provided at either end of the second housing 30, and locking parts 33*a* that are locked with the locking projections 22 of the first housing 10 are formed so as to protrude from the inner surface of each of the locking arms 33. The second housing 30 is attached to the first housing 10 by the engaging projections 31 being inserted through the through-holes in the cable C and engaged with the engagement holes 21 in the first housing 10 and by the locking parts 33*a* being locked with the engaging projections 22 of the first housing 10. As a result, an end portion of the cable C is supported. Furthermore, the two ends of the cable C are supported by being held between the cable supporting projections 20 of the first housing 10 and between the cable supporting parts 32 of the second housing 30. As is shown in FIG. 3, when the one end portion of the cable C is supported by the first housing 10 and the second housing 30, this end of the cable C is provided with a plurality of conductive pads C1 (see FIG. 1) oriented toward the mating direction, and the opposite end of the cable C is oriented by the wall 13 of the first housing 10 toward a direction perpendicular to the mating direction (i.e., toward the cable lead-out direction).

Furthermore, the pull-tab 40 comprises a belt portion 41 that is inserted through the first hole 18 in the housing main body 11 and the second hole 19 in the locking arm 14, and a pull actuator 42 that connects both ends of the belt portion 41. The pull actuator 42 is formed in a substantially rectangular shape that has a large width compared to the width of the belt portion 41. When the pull actuator 42 is pulled in a more or less opposite direction from the mating direction, i.e., in the direction of arrow A in FIG. 4, a force acts on the upper section 17 of the locking arm 14 in the cable lead-out direction which is perpendicular to the mating direction, i.e., in the direction of arrow B, and a force also acts on the upper section 12 of the housing main body 11 in the opposite direction from the cable lead-out direction, i.e., in the direction of arrow D, which causes the locking arm 14 to swing as indicated by the broken line in FIG. 4, and thus causes the relative motion between the upper section 12 of the housing main body 11 and the upper section 17 of the locking arm 14 in mutually approaching directions. As a result, the locking projection 15 of the locking arm 14 is released from the locking projection 55 of the mating connector 50.

Meanwhile, the mating connector 50 comprises a mating housing 51 that is formed by molding an insulating material.

The mating housing 51 has a cable receiving recessed part 52 that receives the end portion of the cable C. A pair of receiving recessed parts 54 is provided at either end portion of the cable receiving recessed part 52 to respectively guide and receive the cable supporting projections 20 and cable supporting parts 32 of the cable connector 1. Furthermore, the mating housing 51 is provided with a plurality of contacts 53 that are formed so as to protrude from both the front and rear surfaces of the cable receiving recessed part 52 into the interior of the cable receiving recessed part 52. These contacts 53 are connected by soldering to the conductor pattern (not shown in the figures) on the circuit board PCB. Moreover, the locking projection 55 with which the locking projection 15 of the cable connector 1 is locked is formed so as to protrude from the front wall of the mating housing 51 in the central portion in the direction of length.

When the cable connector 1 is mated with the mating connector 50, the end portion of the cable C that is supported by the cable connector 1 is inserted into the cable receiving recessed part 52 of the mating connector 50, and the cable supporting projections 20 and cable supporting parts 32 of the cable connector 1 are inserted into the receiving recessed parts 54. As a result, the conductive pads C1 of the cable C and the contacts 53 are electrically connected.

Meanwhile, when the cable connector 1 is mated with the mating connector 50, the locking projection 15 of the locking arm 14 of the cable connector 1 is locked with the locking projection 55 of the mating connector 50 as shown in FIG. 4. This locking action is accomplished by the locking arm 14 first swinging by means of elastic deformation using the area around the linking parts 16 as a pivot in the opposite direction from the cable lead-out direction which is approximately perpendicular to the direction of mating with the mating connector 50, and this locking arm 14 then returning to the original position. Furthermore, the locked state of the locking arm 14 is maintained by the elastic force of the locking arm 14. Accordingly, there is no accidental release of the locked state of the cable connector 1 with the mating connector 50.

Here, the wall 13 that extends approximately perpendicular to the mating direction is provided on the upper section 12 of the housing main body 11, and the cable C is oriented by this wall 13 in a direction crossing the mating direction. Accordingly, when the cable connector 1 is to mate with the mating connector 50, it is possible to press the wall 13, which has sufficient area for pressing with the fingers, and to cause the cable connector 1 to mate easily with mating connector 50. In this case, since the cable C is oriented by the wall 13 in a direction perpendicular to the mating direction, there is no possibility of the cable C getting in the way.

Furthermore, in order to disengage the cable connector 1 from the mating connector 50, the pull actuator 42 is pulled with the fingers in a direction approximately opposite direction from the mating direction, i.e., in the direction of arrow A in FIG. 4. Then, a force acts on the upper section 17 of the locking arm 14 in the cable lead-out direction which is perpendicular to the direction of mating with the mating connector 50, i.e., in the direction of arrow B, and a force also acts on the upper section 12 of the housing main body 11 in the opposite direction from the cable lead-out direction, i.e., in the direction of arrow D. This causes the locking arm 14 to swing, with the area around the linking parts 16 acting as the pivot, in the direction opposite from the cable lead-out direction which is approximately perpendicular to the mating direction, i.e., as indicated with the broken line in FIG. 4. As a result, an approaching motion occurs between the upper section 12 of the housing main body 11 and the upper section 17 of the locking arm 14. This releases the locking projection 15 of the locking arm 14 from the locking projection 55 of the mating connector 50. Accordingly, if the pull actuator 42 is pulled further in the direction of arrow A, the cable connector 1 can be disengaged from the mating connector 50.

During this pull operation of the pull-tab 40, a force in a direction other than the release direction, i.e., the force in the direction of arrow A, is applied by being distributed between the upper section 12 of the housing main body 11 and the upper section 17 of the locking arm 14. Therefore, such a force is not applied to the locking arm 14 alone, so that it is possible to significantly reduce the danger that the locking arm 14 will be damaged or deformed. Furthermore, the locking arm 14 can be released from mating connector 50 by the pull operation of the pull-tab 40 in a more or less opposite direction from the mating direction so that an approaching motion occurs between the upper section 12 of the housing main body 11 and the upper section 17 of the locking arm 14. Accordingly, the locked state can be released smoothly even by the installation of only one locking arm 14, so that it is not necessary to install two or more locking arms 14, thus enabling high-density mounting of the cable connector 1.

Moreover, the corner edge 12*a* in the cable lead-out direction of the first hole 18 provided in the housing main body 11, the corner edges 13*a* and 13*b* of the wall 13 in the cable lead-out direction, the corner edge 17*a* of the second hole 19 provided in the locking arm 14 on the opposite side from the cable lead-out direction, and the corner edge 17*b* of the upper section 17 of the locking arm 14 are formed as rounded surfaces. These rounded surfaces are designed to be contacted by the belt portion 41 of the pull-tab 40 during the pull operation of the pull-tab 40. Accordingly, the pull operation of the pull-tab 40 can be smoothly performed.

An embodiment of the present invention was described above. However, the present invention is not limited to this embodiment, and various alterations and modifications can be made. For example, there is no need to construct the housing that supports the cable from the first housing 10 and second housing 20, i.e., from two bodies; this housing may also be constructed from a single body. Furthermore, the direction in which the cable C is oriented by the wall 13 is not limited to the direction perpendicular to the direction of mating with the mating connector 50; this direction may also be any direction that crosses the direction of mating with the mating connector 50.

What is claimed is:

1. A cable connector comprising:

a housing that supports a cable;

a locking arm in the housing to be locked with a mating connector; and a pull-tab being connected to the locking arm, the pull-tab being inserted into holes that are respectively formed in an upper section of the housing and an upper section of the locking arm such that when the pull-tab is pulled in an approximately opposite direction from the mating direction, the pull-tab causes an approaching motion between the upper section of the housing and the upper section of the locking arm to release the locking arm from the mating connector wherein rounded surfaces which the pull-tab contacts during the pull operation of the pull-tab are respectively formed on the upper section of the housing and the upper section of the locking arm.

2. The cable connector according to claim 1, further comprising linking parts located between the housing and the locking arm.

3. The cable connector according to claim 2, wherein the linking parts act as a pivot point when the pull-tab is pulled.

4. The cable connector according to claim 3, wherein the locking arm has a locking projection located at a bottom of the locking arm opposite the upper section.

5. The cable connector according to claim 4, wherein the locking projection engages a complementary locking projection on a mating housing and is released therefrom when the pull-tab is pulled causing the upper section to move toward each other about the linking parts.

6. The cable connector according to claim 1, wherein a wall that extends in a direction approximately perpendicular to the mating direction is provided at the upper section of the housing, and the cable is oriented by this wall in a direction crossing the mating direction.

7. The cable connector according to claim 6, wherein the wall has corner edges around which a belt portion of the pull-tab passes.

8. The cable connector according to claim 7, wherein the wall has an angled surface located opposite the corner edges for providing a clearance to the upper section of the locking arm on the approaching motion.

* * * * *